US010300315B2

(12) United States Patent
Yang et al.

(10) Patent No.: US 10,300,315 B2
(45) Date of Patent: May 28, 2019

(54) PARTITIONED ANTI-FALLING CONNECTING DEVICE

(71) Applicant: AEROHOOK TECHNOLOGY CO., LTD., Taichung (TW)

(72) Inventors: Kai Chieh Yang, Taichung (TW); Chia Cheng J Huang, Taichung (TW)

(73) Assignee: AKILA TECH CO., LTD., Taoyuan (TW)

( * ) Notice: Subject to any disclaimer, the term of this patent is extended or adjusted under 35 U.S.C. 154(b) by 0 days.

(21) Appl. No.: 15/613,106

(22) Filed: Jun. 2, 2017

(65) Prior Publication Data

US 2018/0345054 A1 Dec. 6, 2018

(51) Int. Cl.
*A62B 35/00* (2006.01)

(52) U.S. Cl.
CPC ..... *A62B 35/0068* (2013.01)

(58) Field of Classification Search
CPC ..... E04G 21/3276; E04G 21/3261
USPC ..... 248/499, 328; 294/82.1, 82.2, 82.19, 294/82.21, 82.17, 82.23
See application file for complete search history.

(56) References Cited

U.S. PATENT DOCUMENTS 5,002,420 A * 3/1991 Loyd ..... B66C 1/36 294/82.1
7,393,033 B1 * 7/2008 Bisso, IV ..... F16G 15/06 294/82.1
7,815,405 B2 * 10/2010 Aftanas ..... B60P 7/15 410/104
8,938,864 B2 * 1/2015 Casebolt ..... A62B 35/0037 24/573.11
2009/0269133 A1 * 10/2009 Van Amelsfoort ... E02F 3/3604 403/408.1
2013/0104374 A1 * 5/2013 Schlangen ..... F16B 45/02 29/525.01

* cited by examiner

*Primary Examiner* — Steven M Marsh
(74) *Attorney, Agent, or Firm* — Raymond Y. Chan; David and Raymond Patent Firm

(57) ABSTRACT

A partitioned anti-falling connecting device includes a frame, a movable latch and a hoist ring. The frame has a hanging space with a gap defined between two ends thereof and at least a division island protrudingly arranged between the two ends thereof so as to divide the frame into at least a first section and a second section. The movable latch is arranged on the frame for opening and closing the gap. The hoist ring comprises a coupling portion for arranging an anti-falling device, wherein the top of the coupling portion has a loop hole corresponding to the frame to insert, such that the loop hole is in allowed to be slidingly arranged between the two ends of the frame and, when affected by gravity, to be restricted by the division island, such that the hoist ring is limited in the first section or the second section, wherein when the effect of gravity is overcome, the loop hole is allowed to be controlled to pass the division island, so as to allow the hoist ring to be optionally switched between the first section and the second section, such that the anti-falling device can be adjusted to the area and position that meet the operational need of the user the most.

14 Claims, 7 Drawing Sheets

PARTITIONED ANTI-FALLING CONNECTING DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a connecting device for arranging anti-falling device, and more particularly to the technical field that controls wobble of the anti-falling device.

Description of Related Arts

Conventional connecting device is illustrated in Taiwan Patent No. 104205356 "Falling Prevention Connecting Device" and Taiwan Patent No. 105206516 "Locking Type Connection Device for Preventing from Falling." However, the inventor of the present invention discovers the drawbacks of these prior cases. Specifically speaking, when a user moves at height, the anti-falling device can wobble greatly all around along the connecting device and make the user's back very uncomfortable due to lots of friction.

Also, the connecting device according to the prior art has two sets of anti-falling devices arranged thereon at the same time for two-hand operation purpose, but these two sets of anti-falling devices can often bump with each other when the user is moving. As a result, it not only generates noise that bothers people, but also highly possibly damages the inner structure of the anti-falling device under the long-term constant bumping, which may lead to the failure of the anti-falling device.

Because of this, the present inventor has elaborately conducted his research and development and eventually come up with the present invention that is able to improve on the drawbacks of conventional connecting devices.

SUMMARY OF THE PRESENT INVENTION

The present invention provides a partitioned anti-falling connecting device, comprising:

a frame, having a hanging space with a gap defined between two ends thereof and at least a division island protrudingly arranged between the two ends of the frame so as to divide the frame at least into a first section and a second section;

a movable latch, arranged on the frame in a manner to open and close the gap; and at least a hoist ring, comprising a coupling portion for arranging anti-falling device, wherein a top of the coupling portion has a loop hole adapted for the frame to insert therein, such that the loop hole is allowed to be slidingly arranged between the two ends of the frame and, when affected by gravity, to be restricted by the division island so as to limit the hoist ring in the first section or the second section, wherein when the effect of gravity is overcome, the loop hole is allowed to be controlled to pass the division island, so as to allow the hoist ring to be optionally switched between the first section and the second section.

It can be understood from the above that the overall arrangement of the frame of the present invention utilizing the division island to limit the hoist ring(s) can indeed improve the problem of the constant wobble around of conventional anti-falling device. Therefore, the present invention has actual effect improvement. Besides, when the gravity effect is overcome, the hoist ring of the present invention is allowed to switch across the division island between the first section and the second section, so as to control and move the anti-falling device to the area and position that meet the operational need of the user the most and greatly enhance the comfort of the user working at height.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
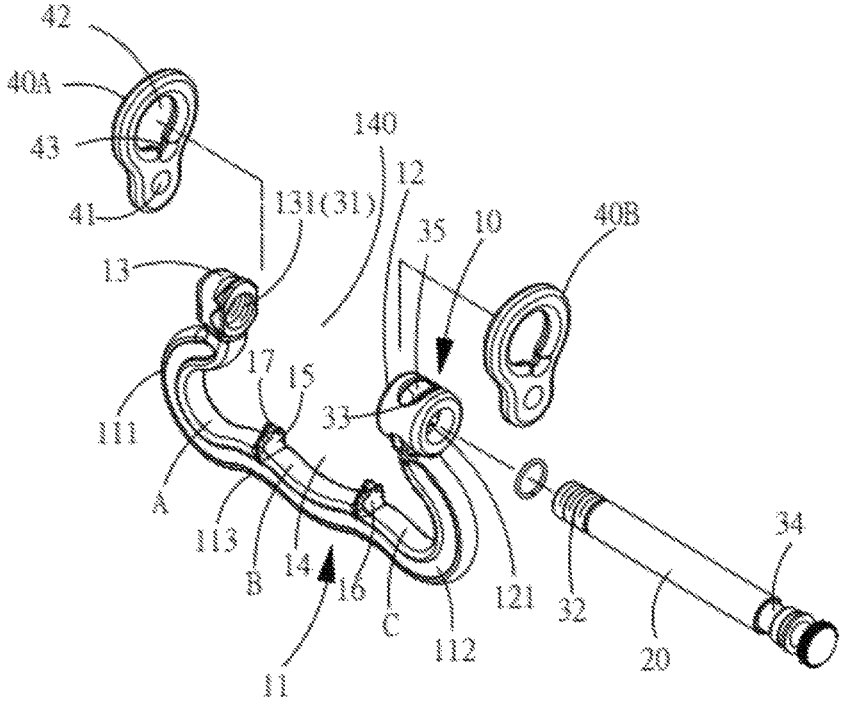
FIG. 1 is an exploded perspective view of the present invention.
Figure 2:
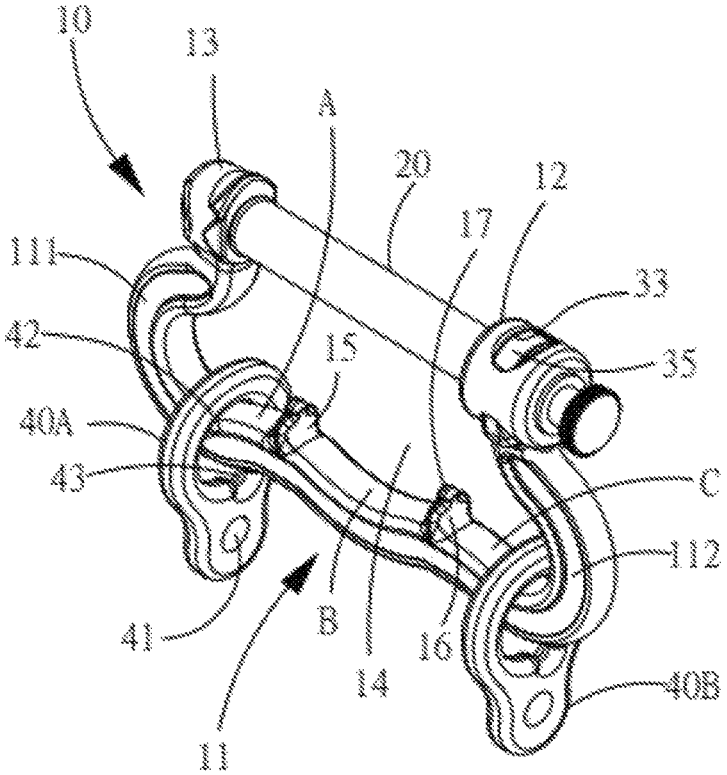
FIG. 2 is a perspective view illustrating an assembly appearance of the present invention closing the gap.
Figure 3:
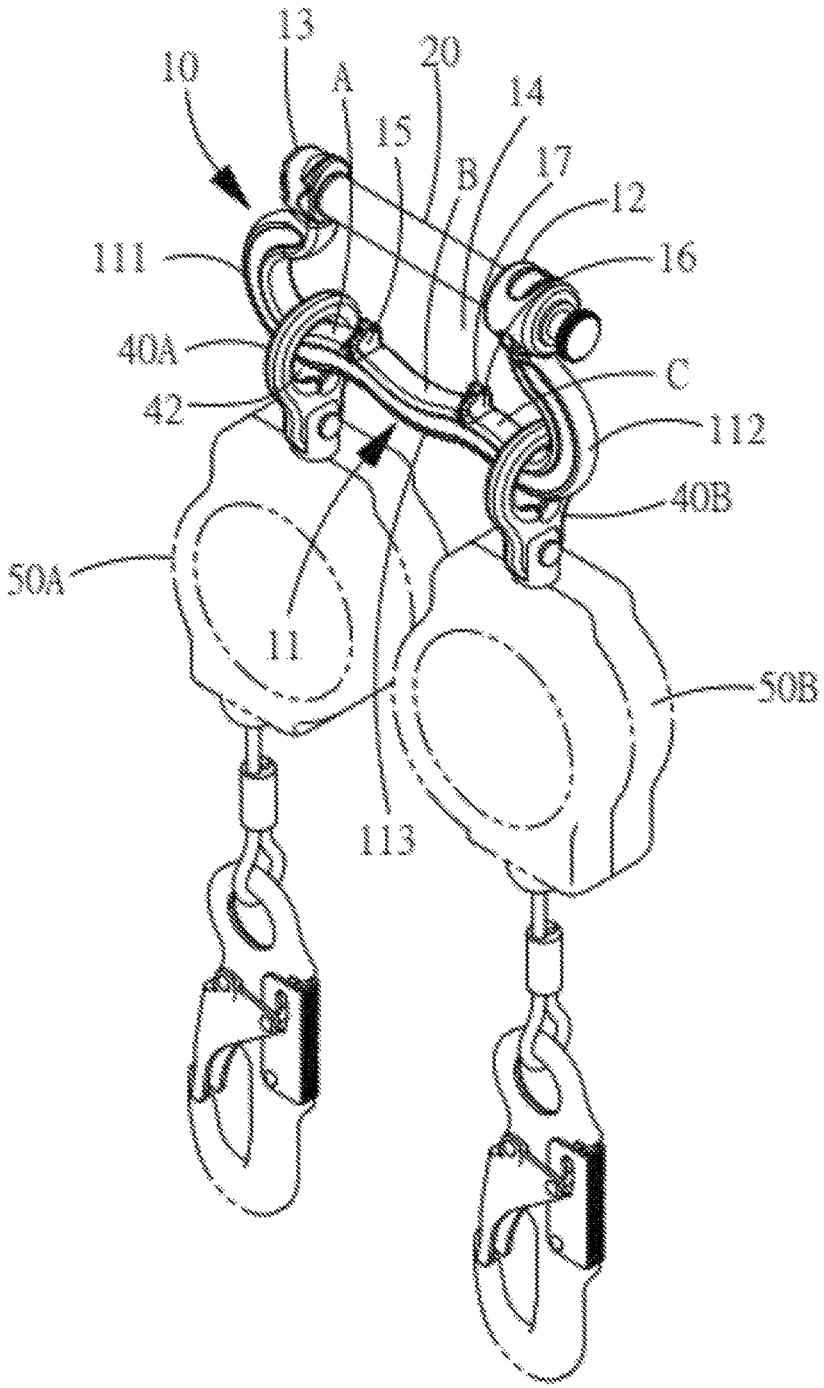
FIG. 3 is a perspective view of the present invention having two anti-falling devices arranged.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1-4, a partitioned anti-falling connecting device according to a preferred embodiment of the present invention is illustrated, which comprises a frame 10, a movable latch 20, a breaking structure, and two hoist rings 40A/40B.

The frame 10 comprises an arm 11, a right bushing 12, and a left bushing 13. The arm 11 comprises a bottom bar 113 bridging an opposite bottom end of a left bar 111 and an opposite bottom end of a right bar 112, so as to define a U-shaped hanging space 14 with a gap 140 facing upward between the two ends thereof for two anti-falling devices 50A, 50B to be put on and off and to be utilized. The bottom bar 113 has two division islands 15, 16 on the inner face thereof and spacingly protruded thereon, so as to divide the bottom bar 113 into a first section A, a second section B, and a third section C from the left to the right thereof. The division islands 15 and 16 further respectively and symmetrically have a first tenon portion 17 in a protruding shape. The right bushing 12 is weldingly arranged on the right end of the arm 11 with respect to the gap 140. The right bushing has a first hole 121 penetrated thereon and horizontally connected to the gap 140. The left bushing 13 is weldingly arranged on the left end of the arm 11 with respect to the gap 140. The left bushing 13 has a second hole 131 adapted for coaxial connection to the first hole 121.

The left edge of the movable latch 20 penetrates the first hole 121 to be mounted in the second hole 131, while the right edge of the movable latch 20 penetrates the first hole 121, such that the movable latch 20 is removably bridged on the first hole 121 and the second hole 131 rendering that the movable latch 20 can axially move along the first hole 121 and the second hole 131 to open and close the gap 140 respectively. It is worth to be especially noted that the movable latch 20 can be pivotally connected with an end of the gap 140 of the frame 10 with an end thereof and be coupled with the other end of the gap 140 of the frame 10 with the other end thereof as well. Therefore, the right bushing 12 and the left bushing 13 are not necessities of the present invention.

The breaking structure comprises a first safety structure section having a female thread 31 arranged on the second hole 131 of the left bushing 13 and a male thread 32, which matches the female thread 31, arranged on the left edge of the movable latch 20, for the movable latch 20 to close the gap 140, and a second safety structure section having a guide slot 33 and a buckle recess 34 correspondingly arranged on the right bushing 12 and the movable latch 20 for the movable latch to close the gap 140. The guide slot 34 comprises a button 35 slidingly arranged thereon adapted for clutching the buckle recess 34. The button 35 comprises a spring (not shown in the drawings) arranged thereon in a manner that the button 35 tend to constantly clutch the buckle recess 34. Accordingly, it can prevent the male thread 32 and the female thread 31 from loosening to each other. Such arrangement of closing and locking the gap 140 with a double security movable latch 20 will certainly not have loosening issue due to incidental contact. If the user likes to open the gap 140 to put on/off the anti-falling device 50A and 50B mentioned below, she or he will have to actuate the button 35 to release the buckle recess 34 first, so that she or he can revolve the movable latch 20 to withdraw the male thread 32 from the female thread 31. Therefore, the breaking structure can effectively control the locking of the movable latch 20 on closing the gap 140, which further prevents the danger of dropping of the anti-falling device 50A and 50B caused by incidental contact from taking place.

The two hoist rings 40A and 40B have hole shaped coupling portions 41 for the anti-falling devices 50A and 50B to correspondingly mount therewith and loop holes 42 penetrated above the coupling portions 41 for the frame 10 to correspondingly insert, such that the loop holes 42 can be slidingly arranged between the two ends of the frame 10. Specifically speaking, one of the loop holes 42 of the hoist ring 40A can be for the left bushing 13, the left bar 111 and the first section A to correspondingly put in as well as be restricted by the left side division island 15 when affected by gravity. As a result, the loop hole 42 of the hoist ring 40A will be limited in the first section A, so as to restrict and restrain the left side anti-falling device 50A. The other one of the loop holes 42 of the hoist ring 40B can be for the right bushing 12, the right bar 112 and the third section C to correspondingly put in as well as be restricted by the right side division island 16 when affected by gravity. As a result, the hoist ring 40B will be limited in the third section C, so as to restrict and restrain the right side anti-falling device 50B.

Figure 4:
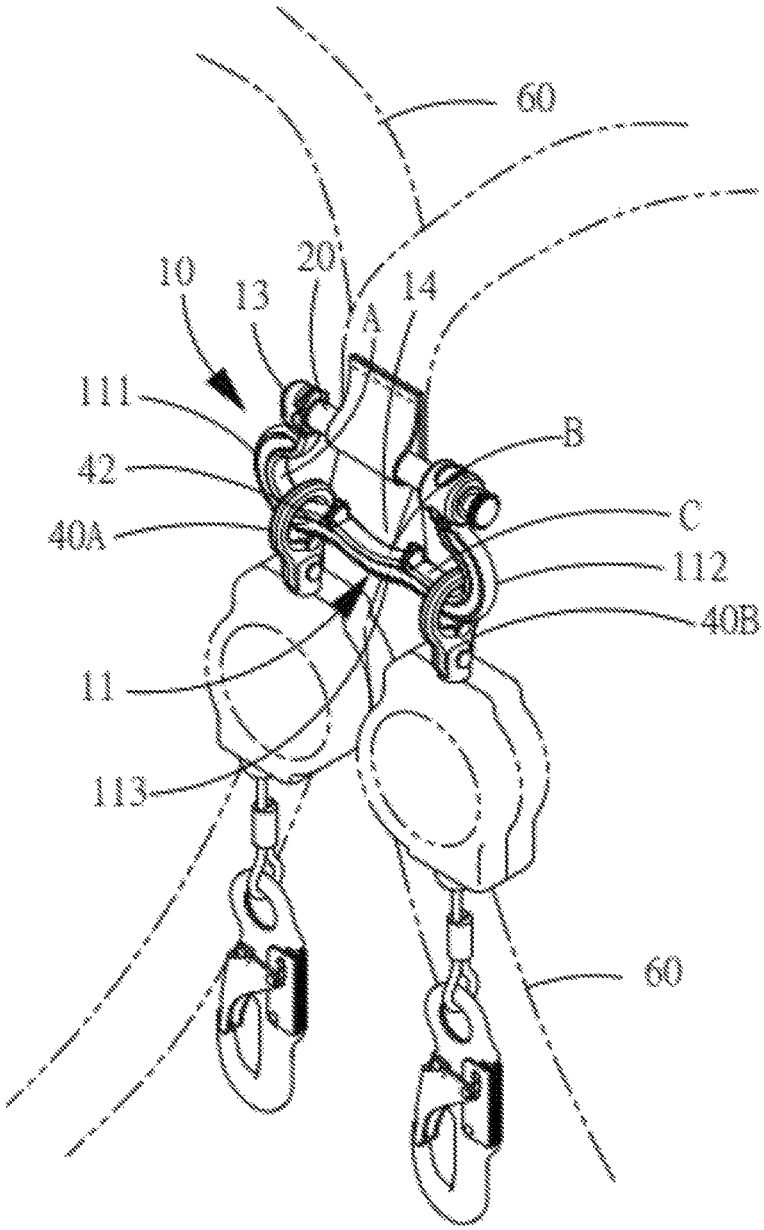
FIG. 4 is a perspective view of an implementation of the present invention utilizing the movable latch for arranging safety harness.

Based on the above description, the two anti-falling devices 50A and 50B will cause action due to gravity to the corresponding hoist ring 40A and 40B at the same time, so as to utilize the left side division island 15 to restrict the left side anti-falling device 50A in the first section A and to utilize the right side division island 16 to restrict the right side anti-falling device 50B in the third section C. This kind of partitioned arrangement of the present invention can indeed improve on the issues of all around wobble and bumping of two anti-falling devices of the prior art when the user is moving. It not only has an actual improvement of noise decrease, but also maintains the structural validity of the anti-falling devices 50A and 50B, so as to ensure the operational safety. FIG. 4 further illustrates that the movable latch 20 according to the preferred embodiment of the present invention is adapted to be coupled with the safety harness worn on the user.

Figure 5:
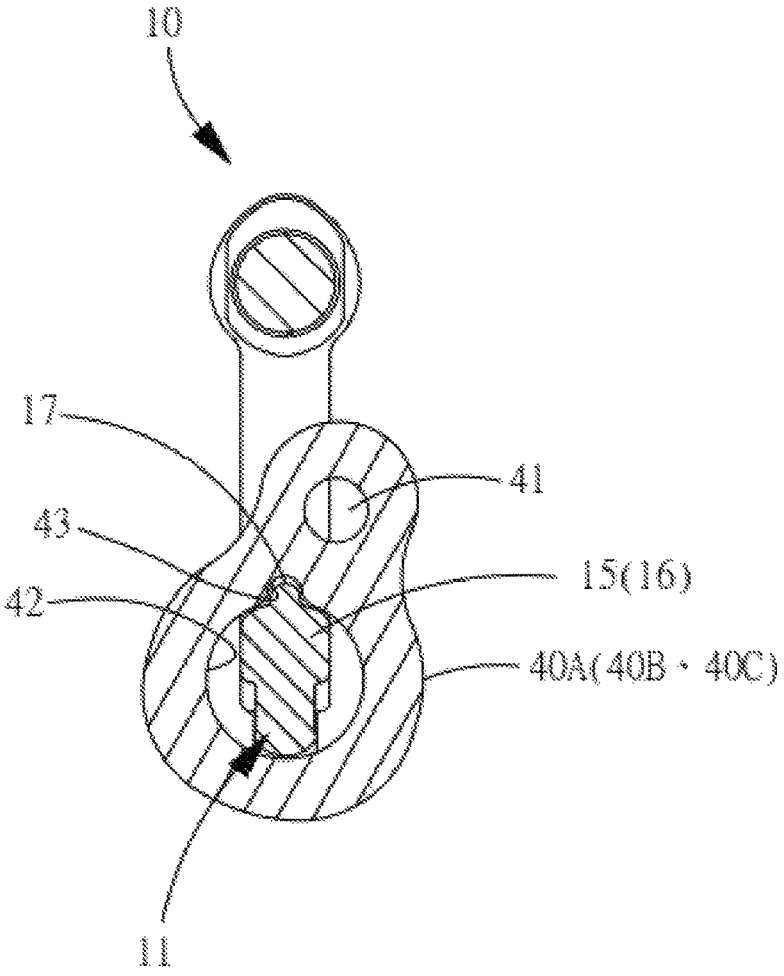
FIG. 5 is a sectional view of the hoist ring of the present invention passing the division island.

Referring to FIGS. 1 and 5, according to the preferred embodiment of the present invention, the hoist rings 40A and 40B respectively have a second tenon portion 43 in a recess shape on the bottom margins thereof matching the protruding shaped first tenon portions 17 respectively, such that when the effect of gravity is overcome and the hoist rings 40A and 40B are turned upward to a specific angle to let the first tenon portion 17 correspond to the second tenon portion 43, the hoist rings 40A and 40B are allowed to pass the corresponding division islands 15 and 16, such that the hoist rings 40A and 40B can be adjusted and rearranged to the position in the first section A, the second section B, or the third section C.

Figure 6:
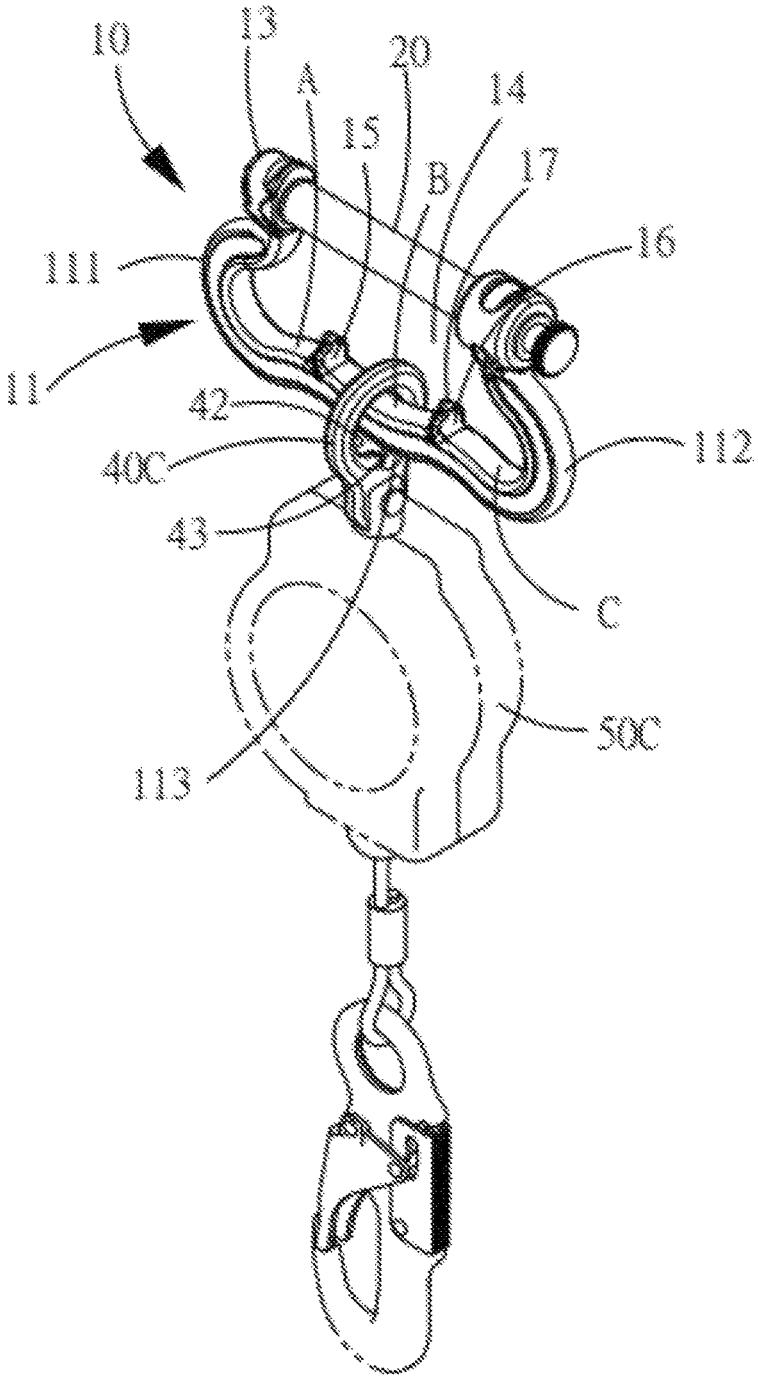
FIG. 6 is a perspective view of the present invention having an anti-falling devices arranged.

Referring to FIGS. 1 and 6, when the present invention is utilized for single anti-falling device 50C, it only has to move a hoist ring 40C to the second section B to be limited between the two division islands 15 and 16, such that the single anti-falling device 50C can be centered and restricted in the second section B. This arrangement can indeed improve on the problems of all around wobble and substantial rubbing on the user's back of single anti-falling device of the prior art when the user is moving. Similarly, those that utilize a division island 15 on the frame 10, according to the preferred embodiment of the present invention, to at least divide a first section A and a second section B and limit a hoist ring 40C in the first section A or the second section C shall also be within the scope of the present invention.

Figure 7:
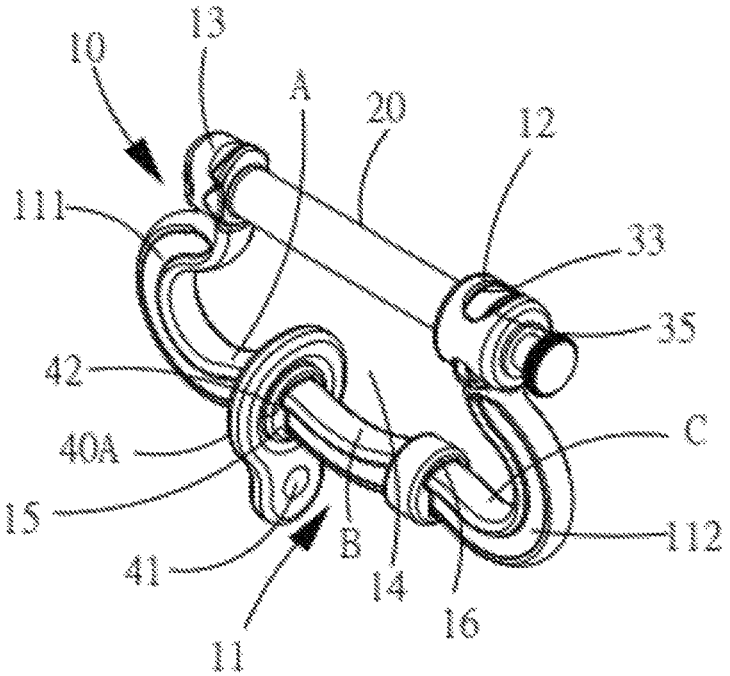
FIG. 7 a perspective view illustrating a division island according to a second preferred embodiment of the present invention.
Figure 8:
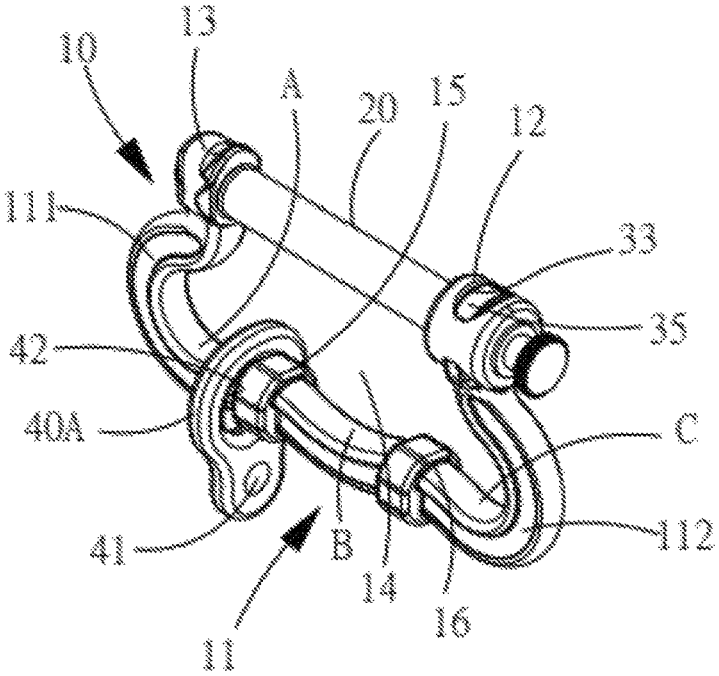
FIG. 8 a perspective view illustrating a division island according to a third preferred embodiment of the present invention.

Referring to FIGS. 7 and 8, it is further illustrated that the first tenon portion 17 and the second tenon portion 43 as shown in FIG. 1 may not be necessities of the present invention. Further, the division islands 15 and 16 can protrude from the periphery of the frame 10 in an arc shaped manner as illustrated in FIG. 7 or protrude from the periphery of the frame 10 in a polygon shaped manner as illustrated in FIG. 8 as long as the left side division island 15 restricts the left side anti-falling device 50A in the first section A and the right side division island 16 restricts the right side anti-falling device 50B in the third section C when the two anti-falling device 50A and 50B cause action due to the gravity to the corresponding hoist ring 40A and 40B at the same time and the loop holes 42 of the two hoist rings 40A and 40B can be force to pass the corresponding division islands 15 and 16 to be optionally switched among the first section A, the second section B and the third section C, so as for the anti-falling device 50A and 50B to be adjusted to the area and position that meet the operational need of the user the most or for specific construction context. Hence, even if the division islands 15 and 16 protrude from the periphery of the frame 10 in a geometric shaped manner, it shall still be within the scope of the present invention.

In view of above, the overall structure and features of the present invention is completely new and novel to the prior arts and is an excellent and outstanding design. It has never been published or seen in the field of similar products. However, the above descriptions are only a preferred embodiment of the present invention, but not to be used to confine the scope of embodying the present invention, which means all equivalent varieties and modifications based on the appended claims of the present invention are within the scope of the present invention. However, the above descriptions are only a preferred embodiment of the present invention, but not to be used to confine the scope of embodying the present invention, which means all equivalent varieties and modifications based on the appended claims of the present invention are within the scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A partitioned anti-falling connecting device, comprising:

a frame, having a hanging space with a gap defined between two ends thereof and at least a division island protrudingly arranged between said two ends thereof so as to divide said frame into at least a first section and a second section;

a movable latch, arranged on said frame in a manner to open and close said gap; and at least a hoist ring, comprising a coupling portion for arranging one or more anti-falling devices, wherein a top of said coupling portion has a loop hole with respect to said frame to insert therein, such that said loop hole is allowed to be slidingly arranged between said two ends of said frame and, when affected by gravity, to be restricted by said division island, such that said hoist ring is limited in one of said first section and said second section, wherein when the effect of gravity is overcome, said loop hole is allowed to be controlled to pass said division island, so as to allow said hoist ring to be optionally switched between said first section and said second section, wherein said frame has two said division islands protrudingly arranged between said two ends of said frame so as to divide said frame into said first section, said second section and a third section from a left to a right thereof, wherein said first section and said third section respectively have a hoist ring limited therein, wherein a loop hole of one of said hoist rings is limited by one of said division islands in a left side thereof when under gravity, wherein when two or more of said hoist rings are provided, another hoist ring is limited by another said division island in a right side thereof when under gravity, wherein said hoist rings are adapted for coupling with an anti-falling device respectively.

2. A partitioned anti-falling connecting device, comprising:

a frame, having a hanging space with a gap defined between two ends thereof and at least a division island protrudingly arranged between said two ends thereof so as to divide said frame into at least a first section and a second section;

a movable latch, arranged on said frame in a manner to open and close said gap; and at least a hoist ring, comprising a coupling portion for arranging one or more anti-falling devices, wherein a top of said coupling portion has a loop hole with respect to said frame to insert therein, such that said loop hole is allowed to be slidingly arranged between said two ends of said frame and, when affected by gravity, to be restricted by said division island, such that said hoist ring is limited in one of said first section and said second section, wherein when the effect of gravity is overcome, said loop hole is allowed to be controlled to pass said division island, so as to allow said hoist ring to be optionally switched between said first section and said second section, wherein said frame has two said division islands protrudingly arranged between said two ends of said frame so as to divide said frame into said first section, said second section, and a third section from a left to a right thereof, wherein said second section comprises a hoist ring arranged thereon, such that said hoist ring is limited between two said division islands, wherein said hoist ring is adapted for coupling with an anti-falling device.

3. The partitioned anti-falling connecting device, as recited in any of claim 1, wherein said frame comprises an arm, a right bushing and a left bushing, wherein said arm comprises a bottom bar bridged on an opposite bottom end of said left bar and an opposite bottom end of said right bar, so as to define a hanging space with a gap facing upward between said two ends of said frame, wherein two said division islands are spacingly protruded on said bottom bar, so as to divide said bottom bar into said first section, said second section, and said third section from said left to said right thereof, wherein said right bushing is arranged on a right end of said arm in respect to said gap, wherein said right bushing has a first hole penetrated therein and horizontally connected to said gap, wherein said left bushing is arranged on a left end of said arm in respect to said gap, wherein said left bushing has a second hole adapted for coaxial connection to said first hole, wherein said movable latch is removably bridged on said first hole and said second hole for opening and closing said gap.

4. The partitioned anti-falling connecting device, as recited in any of claim 2, wherein said frame comprises an arm, a right bushing and a left bushing, wherein said arm comprises a bottom bar bridged on an opposite bottom end of said left bar and an opposite bottom end of said right bar, so as to define a hanging space with a gap facing upward between said two ends of said frame, wherein two said division islands are spacingly protruded on said bottom bar, so as to divide said bottom bar into said first section, said second section, and said third section from said left to said right thereof, wherein said right bushing is arranged on a right end of said arm in respect to said gap, wherein said right bushing has a first hole penetrated therein and horizontally connected to said gap, wherein said left bushing is arranged on a left end of said arm in respect to said gap, wherein said left bushing has a second hole adapted for coaxial connection to said first hole, wherein said movable latch is removably bridged on said first hole and said second hole for opening and closing said gap.

5. The partitioned anti-falling connecting device, as recited in claim 3, further comprising a breaking structure arranged between said frame and said movable latch, wherein said breaking structure further controls a locking of closing of said movable latch to said gap.

6. The partitioned anti-falling connecting device, as recited in claim 4, further comprising a breaking structure arranged between said frame and said movable latch, wherein said breaking structure further controls a locking of closing of said movable latch to said gap.

7. The partitioned anti-falling connecting device, as recited in claim 5, wherein said breaking structure has a female thread arranged on said second hole of said left bushing, a male thread that matches said female thread arranged on a left edge of said movable latch, so as to form a first safety structure section for said movable latch to close said gap, and a guide slot and a buckle recess correspondingly arranged on said right bushing and said movable latch, wherein a button is slidingly arranged on said guide slot adapted for clutching said buckle recess, wherein said button comprises a spring arranged thereon in a manner that said button tends to constantly clutch said buckle recess, so as to form a second safety structure section for said movable latch to close said gap.

8. The partitioned anti-falling connecting device, as recited in claim 6, wherein said breaking structure has a female thread arranged on said second hole of said left bushing, a male thread that matches said female thread arranged on a left edge of said movable latch, so as to form a first safety structure section for said movable latch to close said gap, and a guide slot and a buckle recess correspondingly arranged on said right bushing and said movable latch, wherein a button is slidingly arranged on said guide slot adapted for clutching said buckle recess, wherein said button comprises a spring arranged thereon in a manner that said button tends to constantly clutch said buckle recess, so as to form a second safety structure section for said movable latch to close said gap.

9. The partitioned anti-falling connecting device, as recited in claim 1, wherein said division island has a first tenon portion arranged thereon, wherein said hoist ring has a second tenon portion on said loop hole matching said first tenon portion in a manner that said hoist ring is allowed to pass said division island when said first tenon portion and said second tenon portion faces each other.

10. The partitioned anti-falling connecting device, as recited in claim 1, wherein at least one of said division islands has a first tenon portion arranged thereon, wherein said hoist ring has a second tenon portion on said loop hole matching said first tenon portion in a manner that said hoist ring is allowed to pass said division island when said first tenon portion and said second tenon portion faces each other.

11. The partitioned anti-falling connecting device, as recited in claim 2, wherein at least one of said division islands has a first tenon portion arranged thereon, wherein said hoist ring has a second tenon portion on said loop hole matching said first tenon portion in a manner that said hoist ring is allowed to pass said division island when said first tenon portion and said second tenon portion faces each other.

12. The partitioned anti-falling connecting device, as recited in claim 9, wherein said first tenon portion is in a protruding shape and said second tenon portion is in a recess shape.

13. The partitioned anti-falling connecting device, as recited in claim 10, wherein said first tenon portion is in a protruding shape and said second tenon portion is in a recess shape.

14. The partitioned anti-falling connecting device, as recited in claim 11, wherein said first tenon portion is in a protruding shape and said second tenon portion is in a recess shape.

* * * * *